US005390373A

United States Patent [19]

Flory

[11] Patent Number: 5,390,373

[45] Date of Patent: Feb. 21, 1995

[54] SWIM GOGGLES

[75] Inventor: Edmund L. Flory, Ketchum, Id.

[73] Assignee: Flory, Inc., Philadelphia, Pa.

[21] Appl. No.: 210,583

[22] Filed: Mar. 18, 1994

Related U.S. Application Data

[63] Continuation-in-part of Ser. No. 47,640, Apr. 15, 1993, Pat. No. 5,313,671.

[51] Int. Cl.[6] ..... A61F 9/02

[52] U.S. Cl. ..... 2/430; 2/445; 2/450; 2/452

[58] Field of Search ..... 2/428, 429, 430, 445, 2/452, 450; 351/43, 126, 140, 149, 128, 148, 150, 133, 147

[56] References Cited

U.S. PATENT DOCUMENTS

| | | | |
|---|---|---|---|
| 77,287 | 4/1868 | Hunter | 351/128 X |
| 2,660,092 | 11/1953 | Bloom | 2/450 X |
| 4,162,542 | 7/1979 | Frank | 2/430 |
| 4,468,819 | 9/1984 | Ohno | 2/445 X |

FOREIGN PATENT DOCUMENTS

| | | | |
|---|---|---|---|
| 0685459 | 12/1939 | Germany | 2/452 |
| 0456668 | 11/1936 | United Kingdom | 351/128 |
| 0701450 | 12/1953 | United Kingdom | 351/128 |

*Primary Examiner*—Peter Nerbun
*Attorney, Agent, or Firm*—Craig M. Bell

[57] ABSTRACT

An improved pair of swim goggles, especially designed of competitive swimming, is comprised of two substantially ovoid, convex lenses secured to a soft neoprene base. The goggles are simply and easily tightened about the head by a one pull toggle mechanism that provides an equal, balanced fit of the eye pieces against the face. The goggles provide less hydrodynamic resistance in the water during swimming and not only reduces fatigue by cutting down on eye strain but allows the swimmer both superior frontal and peripheral vision.

17 Claims, 1 Drawing Sheet

SWIM GOGGLES

RELATED APPLICATIONS

The present application is a continuation-in-part of U.S.S.N. 08/047,640, filed Apr. 15, 1993, now U.S. Pat. No. 5,313,671.

FIELD OF INVENTION

The present invention relates generally to protective eyewear, more specifically, protective eyewear that is useful when worn during swimming so as to shield the eyes from water thereby allowing for a clear field of vision. The present invention particularly relates to protective eyewear for use during competitive swimming events.

BACKGROUND OF THE INVENTION

Competitive swimming is a demanding sport that requires full synchronization of all body parts if success is to be achieved. Victory can and is also often decided by fractions of a second and therefore every kick, stroke, and turn must be optimized to nearly perfect timing. Vital to the synchronization and timing is eyesight as clear perception of the visual patterns of the pool walls, ropes, and other swimmers is important so as to cue precisely when each critical movement must be made. This includes frontal vision for determining the distance to the pool wall for each turn and finish as well as peripheral awareness of the other swimmers and lane ropes.

The present invention is directed to an improved pair of hydrodynamically designed eye goggles that provide for increased frontal and peripheral vision as well as reduction in eye glare without increasing the resistance against the water surface.

U.S. Pat. No. 4,286,340 to Lathrop discloses swim goggles with improved peripheral vision comprised of a transversely curved front lens whose axis of curvature is inclined forwardly and downwardly with a flat side lens, the forward position of the circumferential wall of the upper lens is wide enough to avoid concentration of pressure on the eye yet narrow enough to fit comfortably within the narrow portion of the eye socket.

U.S. Pat. No. 4,051,557 to Bengtson discloses eye goggles with improved eye comfort which eliminate eye distortion by having the seal of the eye piece moved out away from the eye sockets and onto the skull bone structure surrounding the eye. U.S. Pat. No. 4,755,040 to Haslbeck also discloses swim goggles comprised of a pair of eye pieces, each eye piece having a lens with an essentially rigid peripheral frame. Each eyepiece has a seal holder and seal gasket, the seal holder being readily deformable but relatively stiff. This allows for a degree of resilience to accommodate certain larger curvatures of the face without excessive distortion. A softer material is also present to provide comfort and a yielding seal accommodates smaller variations in the curvature of the face.

Another variation on the same concept is disclosed in U.S. Pat. No. 5,046,199 to Hall which teaches a pair of sports goggles such as swim goggles which are characterized by the absence of any cushioning on the rear of the eyepieces. The nosepiece of the goggles has a flexible and resilient hinge-piece comprised of a dual lug and pin attachment combination which gives the nose piece flexibility that enables it and the eyepieces to more closely conform to the face of the wearer, thereby doing away with the need for the eyewear cushioning.

U.S. Pat. No. 4,468,819 to Ohno discloses a pair of eye goggles wherein each lens is an integral piece of material comprising a dome-shaped ovoid transparent head that is integral with a relatively stiff frame and extends outwardly from the inner periphery thereof. The lens is provided with a flat outer surface which prevents the optical power from departing from a normal value. This is asserted to be advantageous to swimmers in that the same focal length below and above water is maintained.

U.S. Pat. No. 4,977,627 to Metcalfe et. al., and U.S. Pat. Nos. 5,093,040 and 4,564,960 to Nishivama et. al. disclose various embodiments of eye goggles with replaceable adjustable lenses and head-straps. The lenses are generally attached to a flexible frame which is also the nosepiece whose distal ends are joined to head-straps for securing the goggles to the face. The lenses themselves are comprised of a flat, planar, generally ovoid face that is tapered at the sides to conform to the curvature of the face.

Many, if not all of these swim goggles known in the art cause problems for the wearer that are inherent in their construction. Despite claims of flexibility, the nosepieces often cut the bridge of the nose and are difficult to adjust to a comfortable fit. Since most lenses have seams, the vision is distorted particularly when in the water. They do not provide a clear peripheral vision so as to give the swimmer an idea of where the competition is, and the seams in these lenses create a drag or resistance while moving through the water. This not only slows the swimmer down but tends to pull the goggles from the eye sockets thereby requiring repeated adjustments. Finally, the strap never seem to provide an evenly distributed, snug fit.

None of the swim goggles of the prior art solves the need for extended peripheral and frontal vision during competition without requiring movement of the head either to the side, up or forward. Such movement then disturbs the smooth, timed synchronization of the body which can cost a swimmer a race. It is an object of the present invention to provide a flexible, hydrodynamically superior eye goggle for use in swimming that is constructed so as to allow for an unobstructed frontal and peripheral field of vision without requiring the wearer to move his head from side to side or forwards. Body alignment through the water is obviously a critical function of speed and is greatly affected by head movement which in turn directly affects efficient stroke mechanics. It is a further object of the present invention to provide a set of eye goggles that is snugly and comfortably secured to the face of the wearer by a one-pull strap that insures equal pressure by each eyepiece on the eye socket.

DETAILED DESCRIPTION OF THE INVENTION

As disclosed in copending application U.S.S.N. 08/047,640 filed on Apr. 15, 1993, which is hereby incorporated by reference, the swim goggles of the present invention are comprised of a pair of seamless, generally ovoid-shaped curved lens symmetrically attached to a flexible, neoprene face engaging support that is secured about the wearer's face and head by a one-pull toggle adjusted strap. The seamless, ovoid-shaped lens are more hydrodynamic than anything known in the art and thereby provide less resistance in the water during a race. The surface of the lenses is substantially convex, in that it bends out away from the planar surface of the eye. The convex frontal surface coupled with the oval or tear-drop design of the seamless lens not only is distortion free, as opposed to the lenses known in the art which have at least one or multiple seams and/or ridges, but it also permits the swimmer greater peripheral and frontal vision when swimming. This not only allows the swimmer a superior field of vision to correctly judge the distance to the swimming pool wall so as to properly synchronize his strokes and time his turn, but it also permits him to seethe other swimmers so as to judge where he stands in relation to the competition. All of this can be done without requiring the swimmer to turn his head which would otherwise slow him down or foil his timing.

By cutting down on resistance in the water, the seamless, tear-drop shaped lens of the swim goggles of the present invention also cuts down on external hydrodynamic forces exerted by the water against the neck and shoulder muscles which can contribute to fatigue. This can be a crucial factor in longer marathon-type races and during long periods of practice. The seamless, convex design of the lens also improves racing starts as there is less resistance by the lens when the swimmers head or face enters and slices through the water. Also, by providing both improved peripheral and frontal vision, there is no need to turn the head in order to pick up various visual cues such as distance to the pool wall and hence there is less likelihood for any disturbance in the stroke mechanics, body alignment, and timing.

Figure 1:
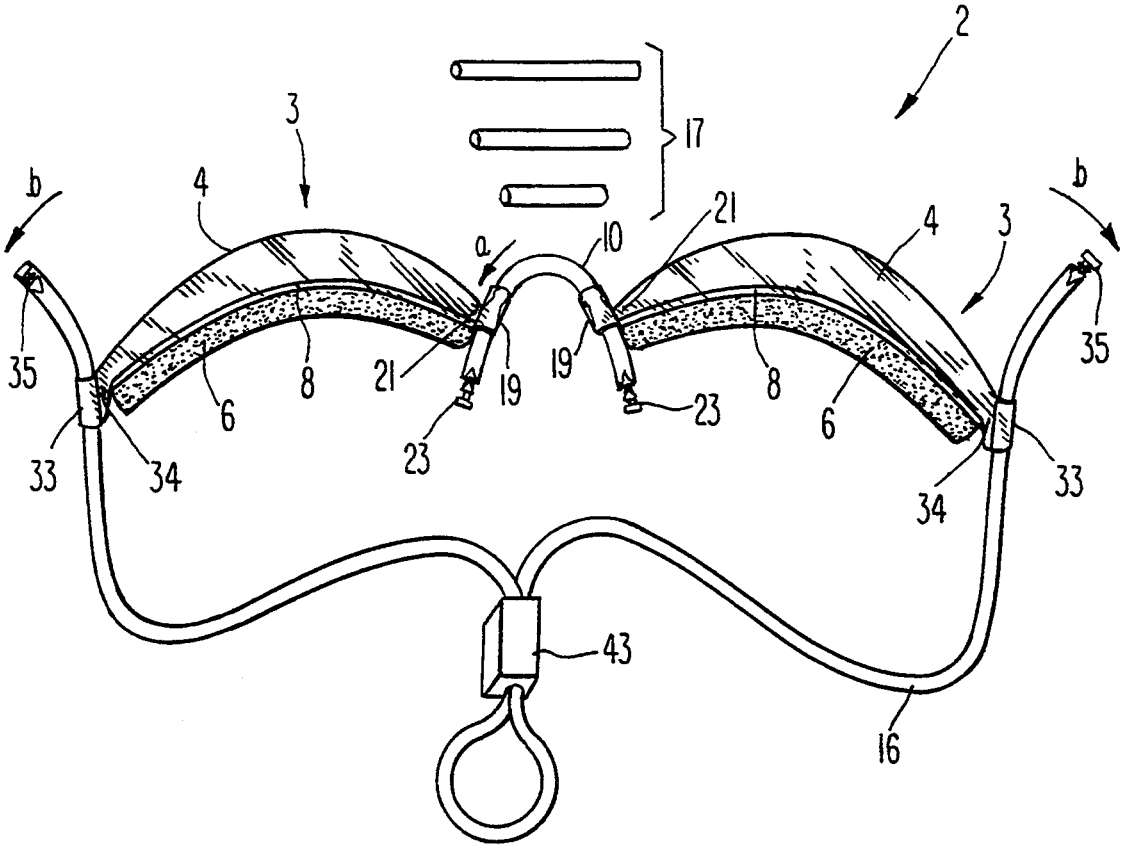
FIG. 1 is a frontal and top composite view of the eye goggles of the present invention.

Referring now to FIG. 1, the eye goggles 2 of the present invention comprise a pair of eyepieces 3 consisting of two seamless, generally ovoid lenses 4 which conform to and are integral with a pair of soft, neoprene supports 6 that act as a cushion to and engage the eye sockets of the wearer's face. The base edge of the lens is formed into a lip 8 over which it contacts the support 6 as the main surface area of the lens is convex and forms away from the eye socket. The lenses are preferably comprised of a UVAB tinted polycarbonate plastic for the reduction of the sun's harmful ultraviolet rays and the glare caused thereby in and off the water. This also allows the swimmer to better discern objects when partially shrouded in shadows or when the water is turbulent. Eye glare causes eye strain and is another factor that is directly responsible for fatigue so that cutting down this impediment is another important factor improving the swimmer's competitive edge.

The lip 8 about the periphery of the lens allows for each of the lenses to be secured directly to the rubberized neoprene base supports 6. This attachment maybe achieved by any number of means known in the art and may be glued, heat sealed, pressure sealed, or molded thereto. Whatever the means used, it is important that the lenses become integrally attached to the supports with no gaps or points of separation. Such a bond insures a water-tight fit with none of the leakage problems that have so often plagued the swim goggles of the prior art.

Between the lens portion 4 of the swim goggles 2 is a nose piece 10 that connects the two lenses at their proximal ends 21. As will be explained more definitively later on, the nose piece 10 bridges the nose of the swimmer when worn and provides a tension that counteracts that of the head-strap 16 and pulls the two lens portions inward against the sides of the nose. This, combined with the opposite, lateral force exerted by the head-strap 16 serves to provide a tight, flush fit for the goggles against the face.

The nosepiece 10, like that disclosed in copending application U.S.S.N. 08/047,640 is a simple, resilient piece of rubber tubing that can be varied in length according to the size of the wearers nose bridge and face 17. The nose piece 10 joins the two lenses 4by threadably passing through a substantially cylinder-shaped eyelet 19 fastened to the proximal ends 21 of each lens 4. The tubing 10 is removable and adjustable by varying its length through selection of the appropriate sized piece.

Figure 2:
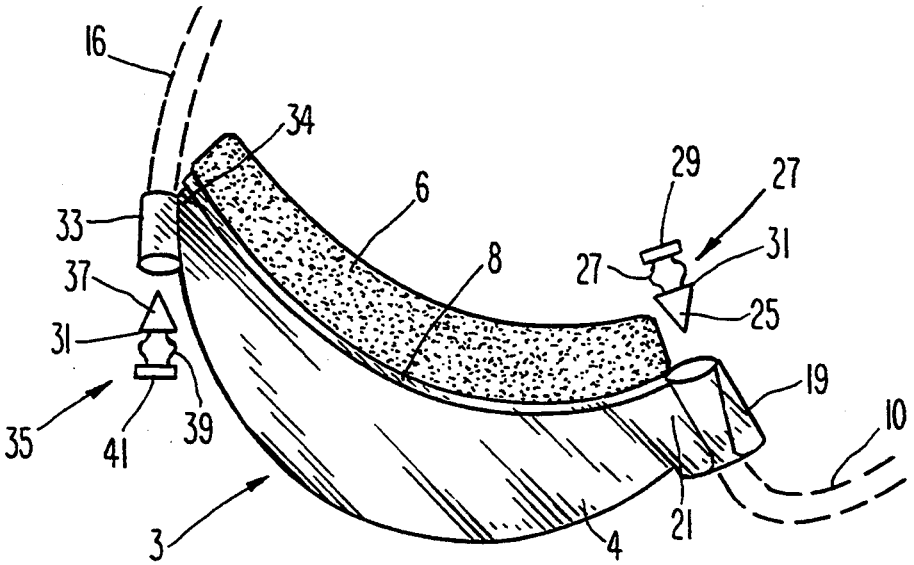
FIG. 2 is an exploded view of the eyelet-post connector combination of the present invention.

Once the tubing is threaded through the eyelets 19 in the direction indicated by the arrows A, and shown in FIG. 1, the nosepiece is secured thereto by the insertion of two small pointed posts 23 which fit into the open ends of the tubing. The two posts, once inserted, create a pressurizing suction within the tubing that holds them therein. The posts are comprised of a barbed, pointed top portion 25, a stem 27 and a base 29 and may be made from any suitable polyethylene or other plastic material. Referring now to FIG. 2, the bottom 31 of the pointed section 25 together with the pressurized suction created therein has a circumference slightly larger than that of the substantially cylindrical eyelets 19 that are secured to the proximal ends 21 of the lens 4. Once the tubing 10 is inserted in the eyelets 19 as shown in FIG. 1, the bottom 31 of the pointed section 25 prevents the tube from being pulled through the eyelet 19. This not only allows for a nose piece 10 that securely fits the wearers face but also allows for the exchange or replacement or the flexible tubing when worn out or to better adapt to a different sized face.

The head-strap 16 is constructed in much the same way and also consists of a piece of flexible, rubber tubing that is threadably connected to the two substantially cylindrical eyelet structures 33 secured to the distal ends 34 of said lenses 4. Functioning in the same manner as the nosepiece 10, the head-strap tubing is secured to two (2) small pointed posts 35 consisting of a top portion 37, a stem portion 39 and a base 41 as that which comprise the post 35 used to secure the nosepiece 10 to the two eyepieces 3. Whereas they are inserted into the ends of the head-strap tubing 16 in a direction opposite to those of the nosepiece, they secure the strap in the same manner as the base of the top pointed section 31 has a circumference greater than that of the inside edge of the cylindrically shaped eyelet 33. Both eyelet/post connector combinations of the distal 34 and proximal 21 sides of the lens are substantially the same size and easily molded thereon. When the strap 16 is tightened against the back of the head, the post is wedged and stuck within the eyelet 33, securing the strap thereto.

As mentioned previously, the resiliency of the tubing of the nosepiece also functions to provide a tighter fit for the goggles against the face as it acts to pull the lens portions 4 tightly against the sides of the nose when worn. The eye goggles of the present invention then, create a duality of forces securing the eye lenses to the face. While head-strap 16 provides a lateral force that pulls back against the face and out toward the temples (see arrow b), the rubberized nosepiece 10 is consequently stretched outward and by its resiliency counters this force and pulls the lens flush with the inner bridge of the nose (arrow a).

Referring again to FIG. 1, the head-strap 16 is easily tightened about the head in a one handed, single pull fashion which is made possible through the use of a simple toggle lock 43 which is pulled flush against the back of the head thereby tightening the circumference of the head-strap 16 that goes around the head and consequently holds the goggles more forcibly against the face and eyes. This provides the lateral forces against the nosepiece 10 as discussed supra. The various toggle embodiments that are possible are discussed more fully in copending U.S.S.N. 08/074,640 which has been incorporated herein by reference.

It is recognized that numerous minor changes and alterations can be made to the eye goggles of the present invention which are not depicted in the drawings or described herein. It is to be understood that those changes which do not materially alter the overall gist of the present invention fall within its spirit and scope as defined by the following claims.

What I claim is:

1. A pair of swim goggles comprising:

a) a seamless, ovoid and convex-shaped pair of lenses, each with a substantially cylindrically shaped eyelet attached to their distal and proximal ends;

b) a substantially flexible support for containment of said lenses;

c) a nosepiece consisting of resilient tubing having end portions that attach to each of said lenses at said proximally attached eyelet by means of a pointed post inserted within the ends of the tubing that secures said ends within said eyelet, and, d) a head-strap attached to said distally attached eyelets for securing said goggles to the wearer's face.

2. The swim goggles of claim 1 wherein said tubing is secured within said eyelets by means of a pointed post inserted within the ends of said tubing.

3. The swim goggles of claim 2 wherein said lenses are comprised of UVAB protected polycarbonate plastic.

4. The swim goggles of claim 3 wherein said pointed posts are comprised of a pointed, barbed top portion, a stem and a base.

5. The swim goggles of claim 4 wherein the circumferences of the pointed portion of said posts is greater than that of the interior surface of the cylindrically shaped eyelets.

6. The swim goggles of claim 5 wherein said head-strap further comprises a toggle lock for securing said swim goggles about the head of the wearer.

7. The swim goggles of claim 6 wherein said support consists of a rubberized neoprene foam base, and said lenses are integrally attached thereto by means of a lip above the outer periphery of said lenses.

8. The swim goggles of claim 7 wherein said head-strap can be tightened or loosened using one hand of the wearer.

9. The swim goggles of claim 8 wherein said tubing is comprised of a material selected form the group consisting of synthetic rubber, latex, and mixtures thereof.

10. The swim goggles of claim 9 wherein said support consists of two separate eyepiece portions comprised of a synthetic neoprene foam to which the lenses are attached.

11. The swim goggles of claim 10 wherein said head-strap, when tightened about the head of the wearer, provides the lenses and support with a symmetrically balanced, water-tight fit about the eyes of the wearer.

12. An improved pair of competition swim goggles comprising two seamless, substantially symmetrical ovoid and convex shaped lenses maintained in an eye-engaging relationship by means of neoprene supports, said lenses being connected by a resilient nosepiece comprised of rubber tubing having end portions that are hollow and secured to said lenses by means of a cylindrically shaped eyelet proximally attached thereto and a pointed post inserted within said end portions and said eyelet.

13. The competition swim goggles of claim 12 wherein said nosepiece is threadably inserted into said eyelet and secured by means of a pointed post.

14. The swim goggles of claim 13 wherein said pointed posts are larger in circumference than the inner lining of said eyelet.

15. The swim goggles of claim 14 wherein said lenses are secured to the head of the wearer by means of a head-strap consisting of resilient tubing threadably secured to substantially cylindrically shaped eyelets distally attached to said lenses.

16. The swim goggles of claim 15 wherein said tubing is threadably secured to said eyelets by means of a pointed post that is inserted within each end of the tubing.

17. The swim goggles of claim 16 wherein said lenses are comprised of UVAB protected polycarbonate plastic.

* * * * *